US009482217B2

(12) United States Patent
Hirata et al.

(10) Patent No.: US 9,482,217 B2
(45) **Date of Patent: *Nov. 1, 2016**

(54) FLUID CONTROL DEVICE

(71) Applicant: Murata Manufacturing Co., Ltd., Nagaokakyo-shi, Kyoto-fu (JP)

(72) Inventors: Atsuhiko Hirata, Nagaokakyo (JP); Yoshinori Ando, Nagaokakyo (JP); Takenobu Maeda, Nagaokakyo (JP); Yukiharu Kodama, Nagaokakyo (JP); Kenta Omori, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 100 days.

This patent is subject to a terminal disclaimer.

(21) Appl. No.: 14/538,979

(22) Filed: Nov. 12, 2014

(65) Prior Publication Data

US 2015/0056087 A1 Feb. 26, 2015

Related U.S. Application Data

(63) Continuation of application No. 13/603,689, filed on Sep. 5, 2012, now Pat. No. 9,103,337.

(30) Foreign Application Priority Data

Sep. 6, 2011 (JP) ..... 2011-194427

(51) Int. Cl.
*F04B 17/03* (2006.01)
*F04B 43/04* (2006.01)
*F04B 45/047* (2006.01)

(52) U.S. Cl.
CPC ..... *F04B 43/046* (2013.01); *F04B 45/047* (2013.01)

(58) Field of Classification Search
CPC ..... F04B 43/046; F04B 45/047
USPC ..... 417/413.2, 413.3, 480
See application file for complete search history.

(56) References Cited

U.S. PATENT DOCUMENTS 6,309,189 B1 * 10/2001 Rey-Mermet et al. .... 417/413.3
7,258,533 B2 * 8/2007 Tanner et al. ..... 417/413.2

(Continued)

FOREIGN PATENT DOCUMENTS

JP 2004-332705 A 11/2004
JP 2005-238761 A 9/2005

(Continued)

OTHER PUBLICATIONS

Hirata et al., "Fluid Control Device", U.S. Appl. No. 13/603,689, filed Sep. 5, 2012.
Hirata et al., "Fluid Control Device", U.S. Appl. No. 13/603,701, filed Sep. 5, 2012.

(Continued)

*Primary Examiner* — Charles Freay
(74) *Attorney, Agent, or Firm* — Keating & Bennett, LLP

(57) ABSTRACT

A fluid control device includes a vibrating plate unit, a driver, and a flexible plate. The vibrating plate unit includes a vibrating plate with first and second main surfaces, a frame plate surrounding the vibrating plate, and a link portion linking the vibrating plate and the frame plate and elastically supporting the vibrating plate against the frame plate. The driver is on the first main surface of the vibrating plate, and vibrates the vibrating plate. The flexible plate having a hole faces the second main surface of the vibrating plate, being fixed to the frame plate. At least a portion of the vibrating plate and the link portion are thinner than the thickness of the frame plate so that the surface of the portion of the vibrating plate and the link portion, on the side of the flexible plate, can separate from the flexible plate.

9 Claims, 7 Drawing Sheets

(56) References Cited

U.S. PATENT DOCUMENTS

| | | | | |
|---|---|---|---|---|
| 2005/0089415 | A1* | 4/2005 | Cho et al. | 417/413.2 |
| 2009/0087323 | A1 | 4/2009 | Blakey et al. | |

FOREIGN PATENT DOCUMENTS

| | | | |
|---|---|---|---|
| JP | 2007-203483 | A | 8/2007 |
| JP | 2008-537057 | A | 9/2008 |

OTHER PUBLICATIONS

Hirata et al., "Fluid Control Device", U.S. Appl. No. 13/603,713, filed Sep. 5, 2012.

Hirata et al., "Fluid Control Device", U.S. Appl. No. 13/603,724, filed Sep. 5, 2012.

Official Communication issued in corresponding Japanese Patent Application No. 2014-204639, mailed on Aug. 25, 2015.

* cited by examiner

FLUID CONTROL DEVICE

CROSS REFERENCE

This non-provisional application claims priority under 35 U.S.C. §119(a) to Patent Application No. 2011-194427 filed in Japan on Sep. 6, 2011, the entire contents of which are hereby incorporated by reference.

BACKGROUND OF THE INVENTION

1. Field of the Invention

The present invention relates to a fluid control device which performs fluid control.

2. Description of the Related Art

International Publication No. 2008/069264 discloses a conventional fluid pump (see FIGS. 1A to 1E). FIG. 1A to FIG. 1E show operations of the conventional fluid pump in a tertiary mode. The fluid pump, as shown in FIG. 1A, includes a pump body 10; a vibrating plate 20 in which the outer peripheral portion thereof is attached to the pump body 10; a piezoelectric element 23 attached to the central portion of the vibrating plate 20; a first opening 11 formed on a portion of the pump body 10 that faces the approximately central portion of the vibrating plate 20; and a second opening 12 formed on either one of a region intermediate between the central portion and the outer peripheral portion of the vibrating plate 20 or a portion of the pump body 10 that faces the intermediate region.

The vibrating plate 20 is made of metal. The piezoelectric element 23 has a size so as to cover the first opening 11 and a size so as not to reach the second opening 12.

In the above mentioned fluid pump, by applying voltage having a predetermined frequency to the piezoelectric element 23, a portion of the vibrating plate 20 that faces the first opening 11 and a portion of the vibrating plate 20 that faces the second opening 12 are bent and deformed in opposite directions, as shown in FIG. 1A to FIG. 1E. This causes the fluid pump to draw fluid from one of the first opening 11 and the second opening 12 and to discharge the fluid from the other opening.

The above mentioned fluid pump, as is shown in FIG. 1A with a conventional structure, has a simple structure, and thus the thickness of the fluid pump can be made thinner. Such a fluid pump is used, for example, as an air transport pump of a fuel cell system.

At the same time, electronic equipment and apparatuses into which the fluid pump is incorporated have tended to be miniaturized. Therefore, it is necessary to further miniaturize the fluid pump without reducing the pump performance (the discharge flow rate and the discharge pressure) of the fluid pump.

However, the performance of the fluid pump decreases as the fluid pump becomes smaller. Therefore, there are limitations to miniaturizing the fluid pump having the conventional structure while maintaining the pump performance.

Accordingly, the inventors of the present invention have devised a fluid pump having a structure shown in FIG. 2.

FIG. 2 is a sectional view showing a configuration of a main portion of the fluid pump. The fluid pump 901 is provided with a flexible plate 35, a vibrating plate unit 38, and a piezoelectric element 32, and is provided with a structure in which the components are layered in that order.

The vibrating plate unit 38 includes a vibrating plate 31, a frame plate 33, and a link portion 34. The vibrating plate unit 38 is formed of metal. In addition, the piezoelectric element 32 and the vibrating plate 31 bonded to the piezoelectric element 32 constitute an actuator 30. The vibrating plate 31 has the frame plate 33 provided therearound. The vibrating plate 31 is linked to the frame plate 33 by the link portion 34. A ventilation hole 35A is formed in the center of the flexible plate 35. Moreover, the frame plate 33 is fixed to the end of the flexible plate 35 by an adhesive agent layer 37. For this reason, the vibrating plate 31 and the link portion 34 are supported by the frame plate 33 in a position spaced away from the flexible plate 35 by a distance equal to the thickness of the adhesive agent layer 37. The link portion 34 has an elastic structure having the elasticity of a small spring constant.

Therefore, the vibrating plate 31 is flexibly and elastically supported at two points against the frame plate 33 by two link portions 34. For this reason, the bending vibration of the vibrating plate 31 generated by expansion and contraction of the piezoelectric element 32 cannot be blocked at all. In other words, the fluid pump 901 has a structure in which the peripheral portion of the actuator 30 is not substantially fixed. Accordingly, there will be a reduction in the loss caused by the bending vibration of the actuator 30.

Consequently, since the flexible plate 35 vibrates with driving of the actuator 30, the amplitude of vibration of the fluid pump 901 is effectively increased. This allows the fluid pump 901 to produce a high discharge pressure and a large discharge flow rate despite the small size and low profile design thereof.

However, in the fluid pump 901, when the frame plate 33 and the flexible plate 35 are fixed by an adhesive agent, an excess amount of the adhesive agent may possibly flow into a gap between the link portion 34 and the flexible plate 35 from the adhesive agent layer 37. Due to this, there is a possibility that the link portion 34 and the flexible plate 35 adhere to each other and block the vibration of the actuator 30.

In addition, although a distance between the vibrating plate 31 and the flexible plate 35 is determined by a thickness of the adhesive agent layer 37, it is extremely difficult to accurately and consistently achieve an exact distance determined by the applied amount of the adhesive agent. For this reason, in the fluid pump 901, a distance between the vibrating plate 31 and the flexible plate 35 that affects the pressure-flow rate characteristics of the fluid pump 901 cannot be accurately and consistently defined. Thus, the fluid pump 901 has a problem that the pressure-flow rate characteristics of the fluid pump 901 fluctuate with each fluid pump 901.

SUMMARY OF THE INVENTION

To overcome the problems described above, preferred embodiments of the present invention provide a fluid control device that prevents vibration of a vibrating plate from being blocked by an adhesive agent as well as prevents fluctuations in pressure-flow rate characteristics.

A fluid control device according to a preferred embodiment of the present invention includes a vibrating plate unit, a driver, and a flexible plate. The vibrating plate unit includes a vibrating plate including a first main surface and a second main surface, a frame plate that surrounds the vibrating plate, and a link portion that links the vibrating plate and the frame plate and elastically supports the vibrating plate against the frame plate. The driver is provided on the first main surface of the vibrating plate, and vibrates the vibrating plate. The flexible plate has a hole, faces the second main surface of the vibrating plate, and is fixed to the frame plate.

At least a portion of the vibrating plate and the link portion are thinner than a thickness of the frame plate so that surfaces of the portion of the vibrating plate and the link portion, on the side of the flexible plate, separate from the flexible plate.

With this configuration, the surface of the link portion, on the side of the flexible plate, is spaced away from the flexible plate. Thus, even if an excess of the adhesive agent flows into a gap between the link portion and the flexible plate, the fluid control device can prevent the link portion from adhering to the flexible plate.

Similarly, with this configuration, the surface of a portion of the vibrating plate on the side of the flexible plate is separated from the flexible plate. Thus, even if an excess of the adhesive agent flows into a gap between a portion of the vibrating plate and the flexible plate, the fluid control device can prevent the portion of the vibrating plate and the flexible plate from adhering to each other.

Therefore, the fluid control device can prevent the portion of the vibrating plate and the link portion, and the flexible plate from adhering to each other as well as blocking the vibration of the vibrating plate.

In addition, with this configuration, the difference between the thickness of a portion of the vibrating plate and the thickness of the frame plate is equivalent to the distance between the portion of the vibrating plate and the flexible plate. In other words, in the fluid control device, the distance that affects the pressure-flow rate characteristics is determined accurately by partially varying the thickness of the vibrating plate unit on the side of the flexible plate. As such, the fluid control device can prevent the pressure-flow rate characteristics from fluctuating with each fluid control device.

Thus, the fluid control device can prevent the vibration of the vibrating plate from being blocked through an inflow of the adhesive agent as well as preventing the fluctuations in pressure-flow rate characteristics.

The vibrating plate unit preferably defines an integral unit.

With this configuration, the distance that affects the pressure-flow rate characteristics is determined accurately by partially varying the thickness of the integrally provided vibrating plate unit on the side of the flexible plate. As such, the fluid control device can prevent the pressure-flow rate characteristics from fluctuating with each fluid control device.

In addition, at least a portion of the vibrating plate and the link portion are made thinner than the thickness of the frame plate by etching, for example.

With this configuration, the surface of the portion of the vibrating plate and the link portion, on the side of the flexible plate, is etched. For this reason, with this configuration, the distance between the portion of the vibrating plate and the link portion, and the flexible plate is accurately determined by the etching depth.

Thus, the fluid control device can further prevent the pressure-flow rate characteristics from fluctuating with each fluid control device.

A portion of the vibrating plate is preferred to be an end of the vibrating plate, of the whole of the vibrating plate, nearest to an adhesion portion between the flexible plate and the frame plate.

With this configuration, the surface of the end of the vibrating plate on the side of the flexible plate is separated from the flexible plate. For this reason, even though an excess of the adhesive agent flows into the gap between the end of the vibrating plate and the flexible plate, the fluid control device prevents the end of the vibrating plate and the flexible plate from adhering to each other. Thus, the fluid control device prevents the end of the vibrating plate and the flexible plate from adhering to each other as well as blocking the vibration of the vibrating plate.

Moreover, preferably, a hole portion is formed in a region of the flexible plate facing the link portion.

With this configuration, when the frame plate and the flexible plate are fixed by the adhesive agent, an excess of the adhesive agent flows into the hole portion. For this reason, the fluid control device can further prevent the vibrating plate and the link portion, and the flexible plate from adhering to each other. In another words, the fluid control device can further prevent the vibration of the vibrating plate from being blocked by the adhesive agent.

Additionally, the vibrating plate and the driver constitute an actuator and, the actuator is preferred to be disc shaped.

With this configuration, the actuator vibrates in a rotationally symmetric pattern (a concentric circular pattern). For this reason, an unnecessary gap is not generated between the actuator and the flexible plate. Therefore, the fluid control device enhances operational efficiency as a pump.

Preferably, the flexible plate includes a movable portion that is positioned in the center or near the center of the region of the flexible plate on a side facing the vibrating plate and can bend and vibrate; and a fixing portion that is positioned outside the movable portion in the region and is substantially fixed.

According to this configuration, the movable portion vibrates with vibration of the actuator. For this reason, in the fluid control device, the amplitude of vibration is effectively increased. Thus, the fluid control device can achieve a higher discharge pressure and a larger discharge flow rate despite the small size and low profile design thereof.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a piezoelectric pump 101 will be described according to a first preferred embodiment of the present invention.

Figure 1A:
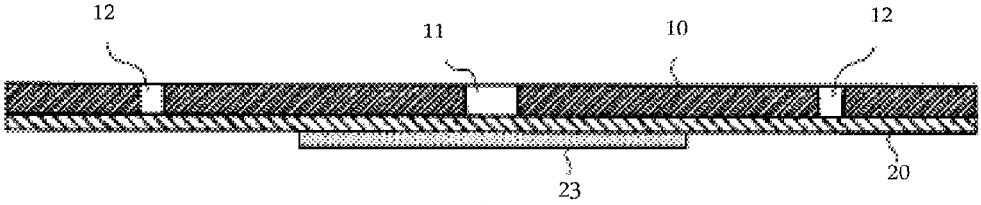
FIG.1A Prior Art
FIG. 1A to FIG. 1E are cross-sectional views of a main portion of a conventional fluid pump.
Figure 1B:
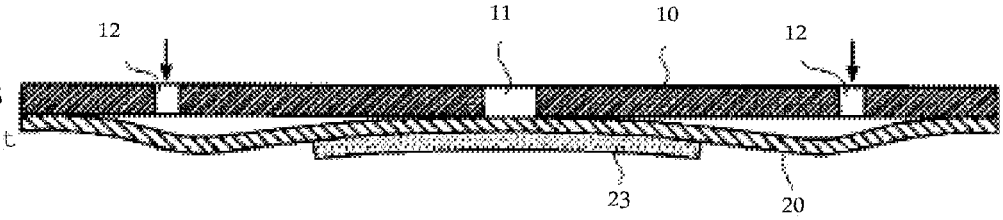
FIG.1B Prior Art
Figure 1C:
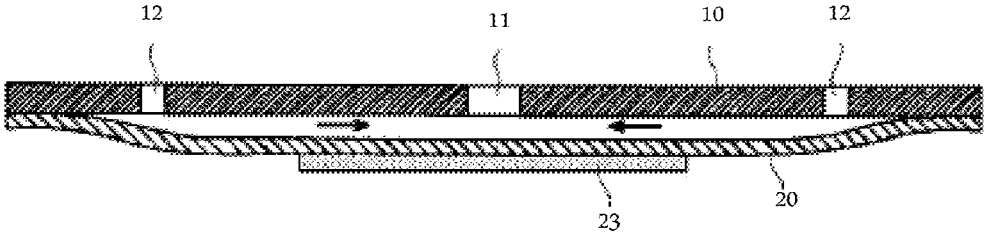
FIG.1C Prior Art
Figure 1D:
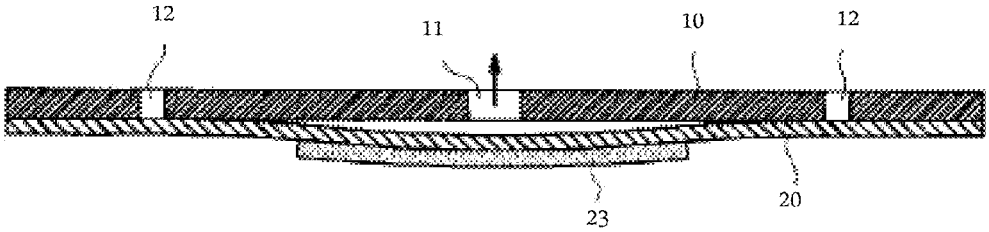
FIG.1D Prior Art
Figure 1E:
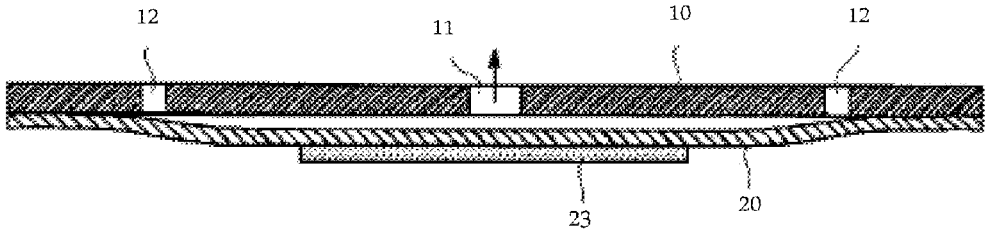
FIG.1E Prior Art
Figure 2:
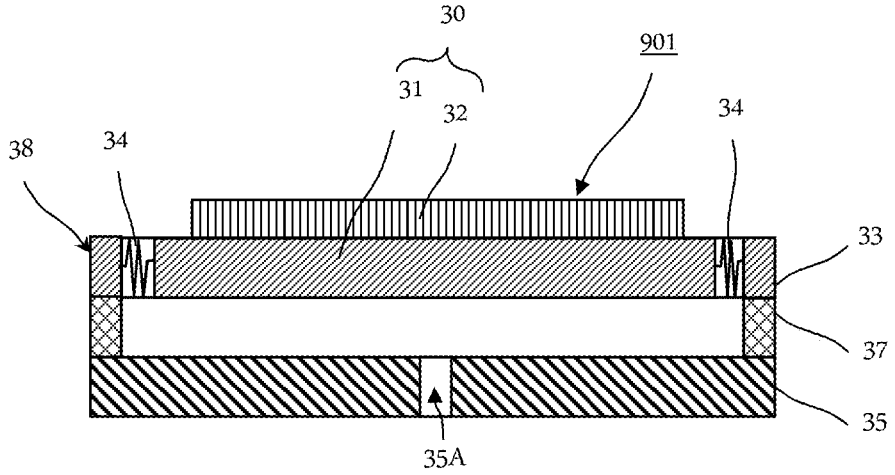
FIG. 2 is a cross-sectional view of a main portion of a fluid pump 901 according to a comparative example of the present invention.
Figure 3:
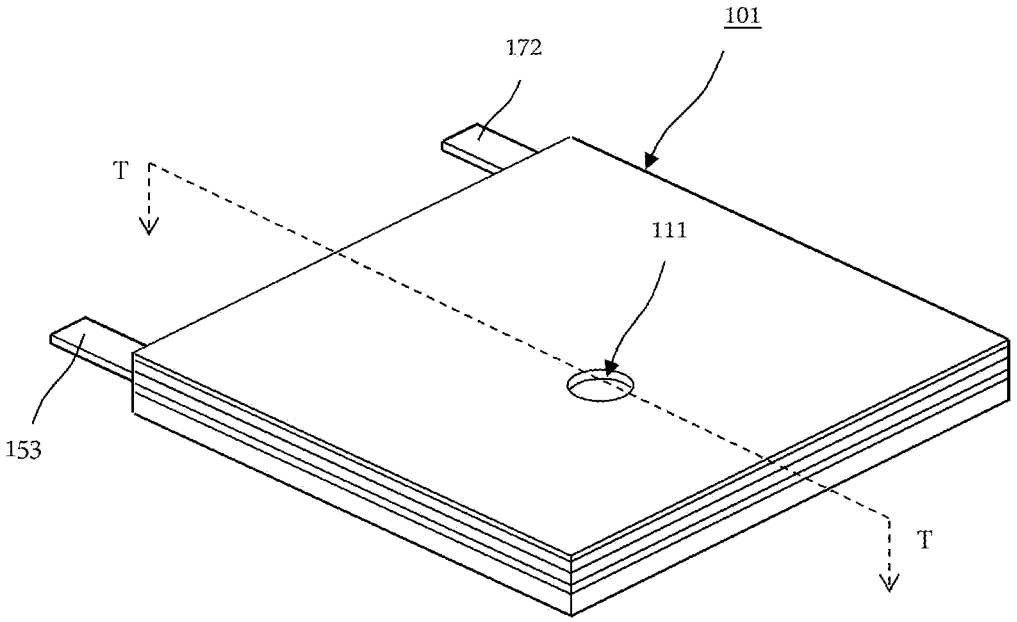
FIG. 3 is an external perspective view of a piezoelectric pump 101 according to a first preferred embodiment of the present invention.
Figure 4:
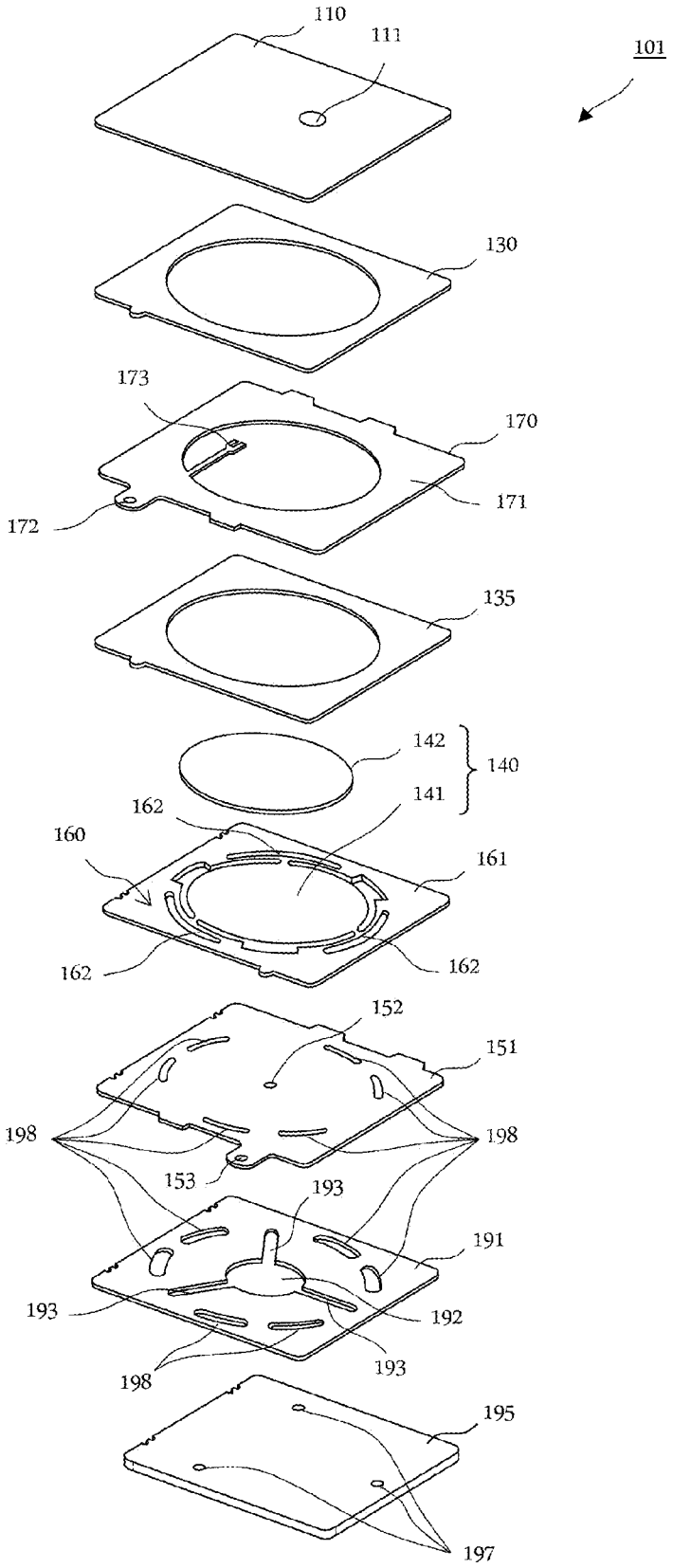
FIG. 4 is an exploded perspective view of the piezoelectric pump 101 as shown in FIG. 3.
Figure 5:
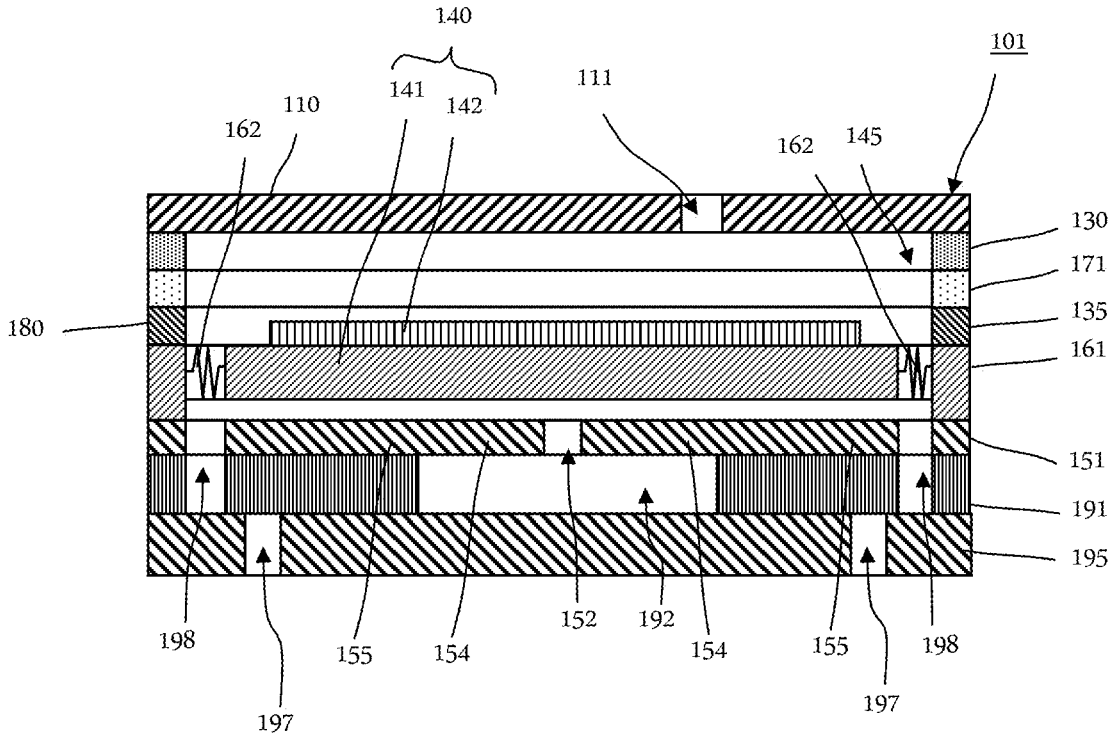
FIG. 5 is a cross-sectional view of the piezoelectric pump 101 as shown in FIG. 3 taken along line T-T.
Figure 6:
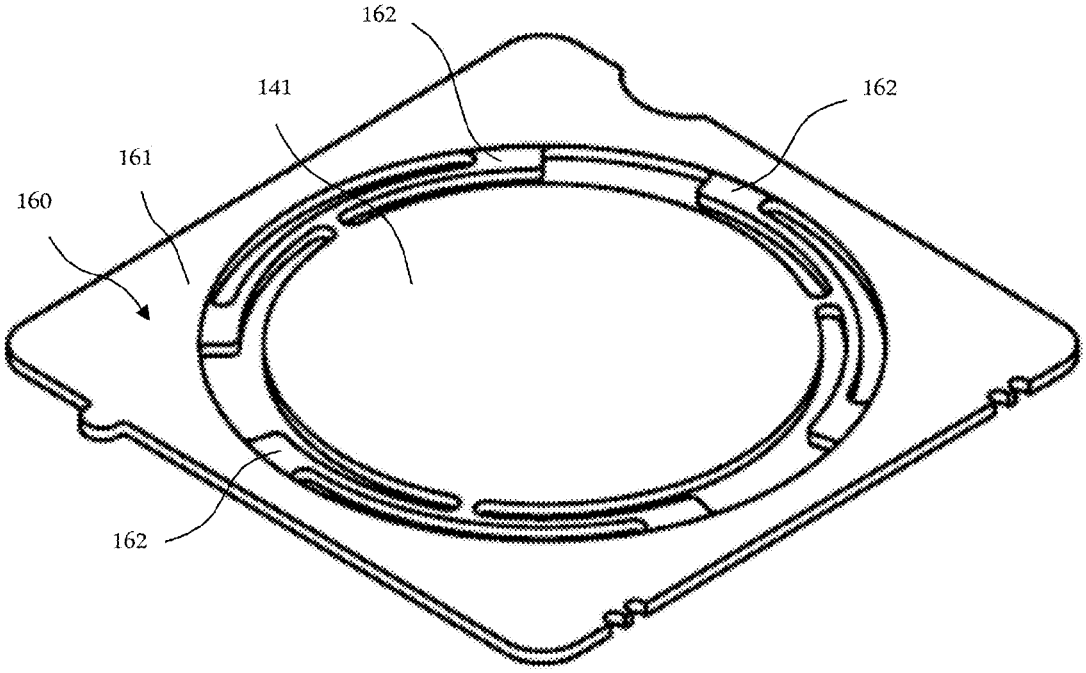
FIG. 6 is an external perspective view of a vibrating plate unit 160 as shown in FIG. 4.

FIG. 3 is an external perspective view of the piezoelectric pump 101 according to the first preferred embodiment of the present invention. FIG. 4 is an exploded perspective view of the piezoelectric pump 101 as shown in FIG. 3. FIG. 5 is a cross-sectional view of the piezoelectric pump 101 as shown in FIG. 3 taken along line T-T. FIG. 6 is an external perspective view of a vibrating plate unit 160 as shown in FIG. 4 as viewed from a flexible plate 151.

As shown in FIG. 3 to FIG. 5, the piezoelectric pump 101 preferably includes a cover plate 195, a base plate 191, a flexible plate 151, a vibrating plate unit 160, a piezoelectric element 142, a spacer 135, an electrode conducting plate 170, a spacer 130, and a lid portion 110. The piezoelectric pump 101 is provided with a structure in which the above components are layered in that order.

A vibrating plate 141 includes an upper surface facing the lid portion 110, and a lower surface facing the flexible plate 151.

The piezoelectric element 142 is adhesively fixed to the upper surface of the vibrating plate 141. The upper surface of the vibrating plate 141 is equivalent to the "first main surface" according to a preferred embodiment of the present invention. Both the vibrating plate 141 and the piezoelectric element 142 preferably are disc shaped. In addition, the vibrating plate 141 and the piezoelectric element 142 define a disc shaped actuator 140. The vibrating plate unit 160 that includes the vibrating plate 141 is preferably formed of a metal material which has a coefficient of linear expansion greater than the coefficient of linear expansion of the piezoelectric element 142. By applying heat to cure the vibrating plate 141 and the piezoelectric element 142 at time of adhesion, an appropriate compressive stress can be left on the piezoelectric element 142 which allows the vibrating plate 141 to bend and form a convex curve on the side of the piezoelectric element 142. This compressive stress can prevent the piezoelectric element 142 from cracking. For example, it is preferred for the vibrating plate unit 160 to be formed of SUS430. For example, the piezoelectric element 142 may be made of lead titanate zirconate-based ceramics. The coefficient of linear expansion for the piezoelectric element 142 is nearly zero, and the coefficient of linear expansion for SUS430 is about $10.4\times10^{-6}$ $K^{-1}$.

It should be noted that the piezoelectric element 142 is equivalent to the "driver" according to a preferred embodiment of the present invention.

The thickness of the spacer 135 may preferably be the same as, or slightly thicker than, the thickness of the piezoelectric element 142.

The vibrating plate unit 160, as shown in FIG. 4 to FIG. 6, preferably includes the vibrating plate 141, the frame plate 161, and a link portion 162. The vibrating plate unit 160 is preferably integrally formed by etching a metal plate, for example. The vibrating plate 141 has the frame plate 161 provided therearound. The vibrating plate 141 is linked to the frame plate 161 by the link portion 162. Additionally, the frame plate 161 is fixed to the flexible plate 151 preferably by the adhesive agent.

As shown in FIG. 5 and FIG. 6, the vibrating plate 141 and the link portion 162 preferably have a thickness that is thinner than the thickness of the frame plate 161 so that surfaces at the flexible plate 151 side of the vibrating plate 141 and the link portion 162 may separate from the flexible plate 151. The vibrating plate 141 and the link portion 162 are preferably made thinner than the thickness of the frame plate 161 by half etching the surface of the vibrating plate 141 and of the link portion 162 on the side of the flexible plate 151. Accordingly, a distance between the vibrating plate 141 and the link portion 162, and the flexible plate 151 is accurately determined to a predetermined size (15 μm, for example) by the depth of the half etching. The link portion 162 has an elastic structure having the elasticity of a small spring constant.

Therefore, the vibrating plate 141 is flexibly and elastically supported preferably at three points against the frame plate 161 by three link portions 162, for example. For this reason, the bending vibration of the vibrating plate 141 cannot be blocked at all. In other words, the piezoelectric pump 101 has a structure in which the peripheral portion of the actuator 140 (as well as the central part) is not substantially fixed.

It is to be noted that the flexible plate 151, an adhesive agent layer 120, the frame plate 161, the spacer 135, the electrode conducting plate 170, the spacer 130, and the lid portion 110 constitute a pump housing 180. Additionally, the interior space of the pump housing 180 is equivalent to a pump chamber 145.

The spacer 135 is adhesively fixed to an upper surface of the frame plate 161. The spacer 135 is preferably made of resin. The thickness of the spacer 135 is the same as or slightly thicker than the thickness of the piezoelectric element 142. Additionally, the spacer 135 constitutes a portion of the pump housing 180. Moreover the spacer 135 electrically insulates the electrode conducting plate 170, described below, with the vibrating plate unit 160.

The electrode conducting plate 170 is adhesively fixed to an upper surface of the spacer 135. The electrode conducting plate 170 is preferably made of metal. The electrode conducting plate 170 includes a frame portion 171 which is a nearly circular opening, an inner terminal 173 which projects into the opening, and an external terminal 172 which projects to the outside.

The leading edge of the inner terminal 173 is soldered to the surface of the piezoelectric element 142. The vibration of the inner terminal 173 can be significantly reduced and prevented by setting a soldering position to a position equivalent to a node of the bending vibration of the actuator 140.

The spacer 130 is adhesively fixed to an upper surface of the electrode conducting plate 170. The spacer 130 preferably is made of resin. The spacer 130 is a spacer that prevents the soldered portion of the inner terminal 173 from contacting the lid portion 110 when the actuator 140 vibrates. The spacer also prevents the surface of the piezoelectric element 142 from coming too close to the lid portion 110, thus preventing the amplitude of vibration from reducing due to air resistance. For this reason, the thickness of the spacer 130 may be equivalent to the thickness of the piezoelectric element 142.

The lid portion 110 with a discharge hole 111 formed thereon is bonded to an upper surface of the spacer 130. The lid portion 110 covers the upper portion of the actuator 140. Therefore, air sucked through a ventilation hole 152, to be described below, of the flexible plate 151 is discharged from the discharge hole 111.

Here, the discharge hole 111 is a discharge hole which releases positive pressure in the pump housing 180 which includes the lid portion 110. Therefore, the discharge hole 111 need not necessarily be provided in the center of lid portion 110.

An external terminal 153 is arranged on the flexible plate 151 to connect electrically. In addition, a ventilation hole 152 is formed in the center of the flexible plate 151.

On a lower surface of the flexible plate 151, the base plate 191 is attached preferably by the adhesive agent. A cylindrical opening 192 is formed in the center of the base plate 191. A portion of the flexible plate 151 is exposed to the base plate 191 at the opening 192 of the base plate 191. The circularly exposed portion of the flexible plate 151 can vibrate at a frequency substantially the same as a frequency of the actuator 140 through the fluctuation of air pressure accompanying the vibration of the actuator 140. In another words, by the configuration of the flexible plate 151 and the base plate 191, a portion of the flexible plate 151 facing the opening 192 serves as the circular movable portion 154 capable of bending and vibrating. The movable portion 154 corresponds to a portion in the center or near the center of the region facing the actuator 140 of the flexible plate 151. Furthermore, a portion positioned outside the movable portion 154 of the flexible plate 151 serves as the fixing portion 155 that is fixed to the base plate 191. The characteristic frequency of the movable portion 154 is designed to be the same as or slightly lower than the driving frequency of the actuator 140.

Accordingly, in response to the vibration of the actuator 140, the movable portion 154 of the flexible plate 151 also vibrates with large amplitude, centering on the ventilation hole 152. If the vibration phase of the flexible plate 151 is a vibration phase delayed (for example, 90 degrees delayed) from the vibration of the actuator 140, the thickness variation of a gap between the flexible plate 151 and the actuator 140 increases substantially. As a result, the piezoelectric pump 101 improves pump performance (the discharge pressure and the discharge flow rate).

The cover plate 195 is bonded to a lower surface of the base plate 191. Three suction holes 197 are provided in the cover plate 195. The suction holes 197 communicate with the opening 192 through a passage 193 formed in the base plate 191.

The flexible plate 151, the base plate 191, and the cover plate 195 are preferably made of a material having a coefficient of linear expansion greater than a coefficient of linear expansion of the vibrating plate unit 160. In addition, the flexible plate 151, the base plate 191, and the cover plate 195 are preferably made of a material having approximately the same coefficient of linear expansion. For example, it is preferable to have the flexible plate 151 that is made of substances such as beryllium copper. It is preferable to have the base plate 191 that is made of substances such as phosphor bronze. It is preferable to have the cover plate 195 that is made of substances such as copper. These coefficients of linear expansion are approximately $17\times10^{-6}$ $K^{-1}$. Moreover, it is preferable to have the vibrating plate unit 160 that is made of SUS430. The coefficient of linear expansion of SUS430 is about $10.4\times10^{-6}$ $K^{-1}$.

In this case, due to the differences in the coefficients of linear expansion of the flexible plate 151, the base plate 191, and the cover plate 195 in relation to the frame plate 161, by applying heat to cure the flexible plate 151 at time of adhesion, a tension which makes the flexible plate 151 bend and form a convex curve on the side of the piezoelectric element 142, is applied to the flexible plate 151. Thus, a tension which makes the movable portion capable of bending and vibrating is adjusted on the movable portion 154. Furthermore, the vibration of the movable portion 154 is not blocked due to any slack on the movable portion 154. It is to be understood that since the beryllium copper which constitutes the flexible plate 151 is a spring material, even if the circular movable portion 154 vibrates with large amplitude, there will be no permanent set-in fatigue or similar symptoms. In another words, beryllium copper has excellent durability.

In the above structure, when a driving voltage is applied to the external terminals 153, 172, the actuator 140 of the piezoelectric pump 101 concentrically bends and vibrates. Furthermore, in the piezoelectric pump 101, the movable portion 154 of the flexible plate 151 vibrates from the vibration of the vibrating plate 141. Thus, the piezoelectric pump 101 sucks air from the suction hole 197 to the pump chamber 145 through the ventilation hole 152. Then, the piezoelectric pump 101 discharges the air in the pump chamber 145 from the discharge hole 111. In this state of the piezoelectric pump 101, the peripheral portion of the vibrating plate 141 is not substantially fixed. For that reason, the piezoelectric pump 101 has less loss caused by the vibration of the vibrating plate 141, while being small and low profile, and can obtain a high discharge pressure and a large discharge flow rate.

In addition, in the piezoelectric pump 101, the surface of the link portion 162 on the side of the flexible plate 151 is separated from the flexible plate 151. Therefore, the piezoelectric pump 101 can prevent the link portion 162 and the flexible plate 151 from adhering to each other even if the excess of the adhesive agent flows into a gap between the link portion 162 and the flexible plate 151.

Similarly, in the piezoelectric pump 101, the lower surface of the vibrating plate 141 on the side of the flexible plate 151 is separated from flexible plate 151. For that reason, the piezoelectric pump 101 can prevent the vibrating plate 141 and the flexible plate 151 from adhering to each other even if the excess of the adhesive agent flows into a gap between the vibrating plate 141 and the flexible plate 151. Here, the lower surface of the vibrating plate 141 is equivalent to the "second main surface" according to a preferred embodiment of the present invention.

Thus, the piezoelectric pump 101 can prevent the vibrating plate 141 and the link portion 162 and the flexible plate 151 from adhering to each other and blocking the vibration of the vibrating plate 141.

Additionally, in the piezoelectric pump 101, a difference between the thickness of the vibrating plate 141 and the thickness of the frame plate 161 is equivalent to a distance between the vibrating plate 141 and the flexible plate 151. In another words, in the piezoelectric pump 101, the distance that affects the pressure-flow rate characteristics is determined by the depth of the half etching to the vibrating plate 141.

It is possible for precise setting of the depth of this half etching. Thus, the piezoelectric pump 101 prevents the pressure-flow rate characteristics from varying with each piezoelectric pump 101.

As described above, the piezoelectric pump 101 prevents vibration of the vibrating plate 141 from being blocked by the adhesive agent and prevents fluctuations in the pressure-flow rate characteristics.

Both the actuator 140 and the flexible plate 151 bend and form convex curves on the side of the piezoelectric element 142 at normal temperature by approximately the same amount. Here, when a temperature of the piezoelectric pump 101 rises by generation of heat at the time of driving the piezoelectric pump 101, or when an environmental temperature rises, a warp of the actuator 140 and the flexible plate 151 decreases, and both the actuator 140 and the flexible plate 151 deform in parallel by approximately the same amount. In another words, a distance between the vibrating plate 141 and the flexible plate 151 does not change in temperature. Additionally, the distance is determined by the depth of the half etching to the vibrating plate 141 as mentioned above.

Consequently, the piezoelectric pump 101 can maintain proper pressure-flow rate characteristics of a pump over a wide temperature range.

Figure 7:
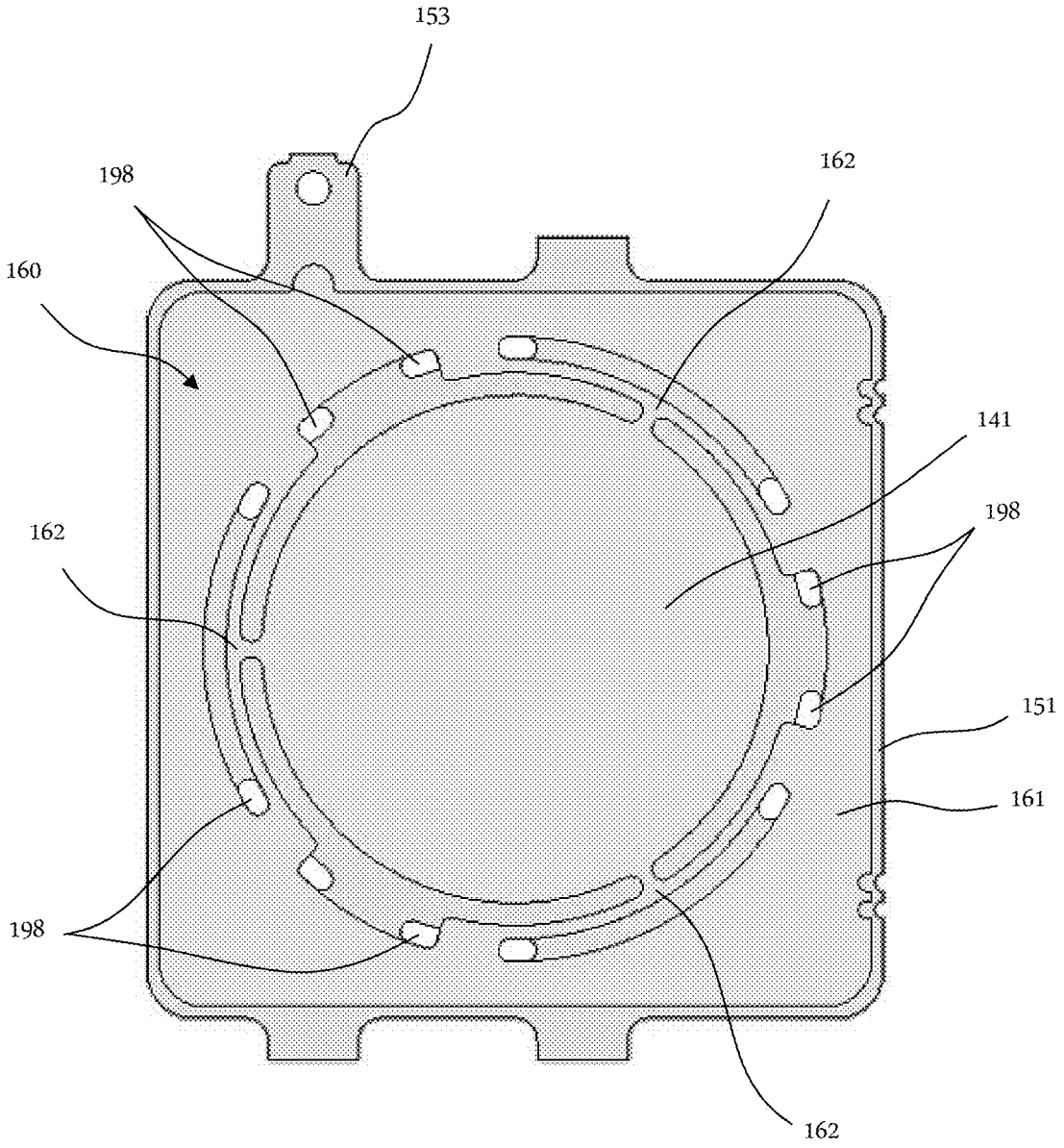
FIG. 7 is a plan view of a bonding body of the vibrating plate unit 160 and a flexible plate 151 as shown in FIG. 4.

FIG. 7 is a plan view of a bonding body of the vibrating plate unit 160 and the flexible plate 151 as shown in FIG. 4.

As shown in FIG. 4 to FIG. 7, it is preferable that a hole portion 198 is provided in the region facing the link portion 162 in the flexible plate 151 and the base plate 191. Thus, when the frame plate 161 and the flexible plate 151 are fixed preferably by the adhesive agent, the excess of the adhesive agent flows into the hole portion 198.

Thus, the piezoelectric pump 101 prevents the vibrating plate 141 and the link portion 162 and the flexible plate 151 from adhering to each other and blocking the vibration of the vibrating plate 141.

Other Preferred Embodiments

While the actuator 140 having a unimorph type structure and undergoing bending vibration was provided in the above mentioned preferred embodiments, the structure is not limited thereto. For example, it is possible to attach a piezoelectric element 142 on both sides of the vibrating plate 141 so as to have a bimorph type structure and undergo bending vibration.

Moreover, in the above described preferred embodiments, while the actuator 140 which undergoes bending vibration due to expansion and contraction of the piezoelectric element 142 was provided, the method is not limited thereto. For example, an actuator which electromagnetically undergoes bending vibration may be provided.

In the preferred embodiments of the present invention described above, while the piezoelectric element 142 is preferably made of lead titanate zirconate-based ceramics, the material is not limited thereto. For example, an actuator may be made of a piezoelectric material of non-lead based piezoelectric ceramics such as potassium-sodium niobate based or alkali niobate based ceramics.

Additionally, while the above described preferred embodiments of the present invention showed an example in which the piezoelectric element 142 and the vibrating plate 141 preferably have roughly the same size, there are no limitations to the size. For example, the vibrating plate 141 may be larger than the piezoelectric element 142.

Moreover, although the disc shaped piezoelectric element 142 and the disc shaped vibrating plate 141 were preferably used in the above mentioned preferred embodiments, there are no limitations to the shape. For example, either of the piezoelectric element 142 or the vibrating plate 141 can be a rectangle or a polygon.

In addition, while a thickness of the entire vibrating plate 141 is preferably thinner than the thickness of the frame plate 161, there are no limitations to the thickness. For example, the thickness of at least a portion of the vibrating plate 141 may be thinner than the thickness of the frame plate 161. However, a portion of the vibrating plate 141 is preferred to be an end of the vibrating plate, of the entire vibrating plate 141, nearest to an adhesion portion between the flexible plate 151 and the frame plate 161.

Additionally, in the above described preferred embodiments, while the link portion 162 is preferably provided at three spots, the number of places is not limited thereto. For example, the link portion 162 may be provided at only two spots or the link portion 162 may be provided at four or more spots. Although the link portion 162 does not block vibration of the actuator 140, the link portion 162 does more or less affect the vibration of the actuator 140. Therefore, the actuator 140 can be held naturally by linking (holding) the actuator at three spots, for example, and the position of the actuator 140 is held accurately. The piezoelectric element 142 can also be prevented from cracking.

In addition, the actuator 140 may be driven in an audible frequency band in various preferred embodiments of the present invention if it is used in an application in which the generation of audible sounds does not cause problems.

Moreover, while the above described preferred embodiments show an example in which one ventilation hole 152 is preferably disposed at the center of a region facing the actuator 140 of the flexible plate 151, there are no limitations to the number of holes. For example, a plurality of holes may be disposed near the center of the region facing the actuator 140.

Further, while the frequency of driving voltage in the above mentioned preferred embodiments is determined so as to make the actuator 140 vibrate in a primary mode, there are no limitations to the mode. For example, the driving voltage frequency may be determined so as to vibrate the actuator 140 in other modes such as a tertiary mode.

In addition, while air is preferably used as fluid in the above mentioned preferred embodiments, the fluid is not limited thereto. For example, any kind of fluid such as liquids, gas-liquid mixture, solid-liquid mixture, and solid-gas mixture can be applied to the above preferred embodiments.

Finally, the above described preferred embodiments are to be considered in all respects as illustrative and not restrictive. The scope of the present invention is defined not by above described preferred embodiments but by the claims. Further, the scope of the present invention is intended to include all modifications that come within the meaning and scope of the claims and any equivalents thereof.

What is claimed is:

1. A fluid control device comprising:

a vibrating plate unit including:

a vibrating plate that includes a first main surface and a second main surface;

a frame plate that surrounds the vibrating plate with a gap between the frame plate and the vibrating plate; and a link portion that links the vibrating plate and the frame plate and connects a portion of the vibrating plate and the frame plate;

a driver that is provided on the first main surface, and vibrates the vibrating plate; and a flexible plate that includes a hole portion formed in a region in which the flexible plate faces the link portion, faces the second main surface of the vibrating plate, and is fixed to the frame plate.

2. The fluid control device according to claim 1, wherein at least a portion of the vibrating plate and the link portion are thinner than a thickness of the frame plate so that the portion of the vibrating plate and the link portion are separate from the flexible plate.

3. The fluid control device according to claim 1, wherein the vibrating plate unit is an integral unit.

4. The fluid control device according to claim 1, wherein at least the portion of the vibrating plate and the link portion are made thinner than the frame plate.

5. The fluid control device according to claim 1, wherein the portion of the vibrating plate is formed in an end of the vibrating plate nearest to an adhesion portion between the flexible plate and the frame plate.

6. The fluid control device according to claim 1, wherein the vibrating plate and the driver constitute an actuator and the actuator is disc shaped.

7. The fluid control device according to claim 1, wherein the flexible plate comprises:

a movable portion that is positioned in a center or in an area of the center of a region in which the flexible plate faces the vibrating plate and is arranged to bend and vibrate; and a fixing portion that is positioned in an area outside the movable portion of the flexible plate and is substantially fixed.

8. The fluid control device according to claim 1, further comprising a plurality of link portions.

9. The fluid control device according to claim 1, wherein the link portion comprises:

an extending portion that extends along the gap;

a first linking portion that links the extending portion and the vibrating plate; and a second linking portion that links the extending portion and the frame plate, and a position in which the first linking portion and the vibrating plate are connected to each other is different from a position in which the second linking portion and the frame plate are connected to each other, in a direction in which the extending portion extends.

* * * * *